US005766114A

United States Patent [19]

Campbell

[11] Patent Number: 5,766,114

[45] Date of Patent: Jun. 16, 1998

[54] INFANT WALKING AND SWIMMING AID

[76] Inventor: Douglas O. Campbell, 10141 E. Prairie Dog La., Tucson, Ariz. 85749

[21] Appl. No.: 552,633

[22] Filed: Nov. 3, 1995

[51] Int. Cl.[6] ..... A63B 31/00

[52] U.S. Cl. ..... 482/55; 441/108; 441/112; 441/116

[58] Field of Search ..... 441/108, 111, 441/112, 114, 115, 116, 119, 125; 482/55

[56] References Cited

U.S. PATENT DOCUMENTS

| | | |
|---|---|---|
| 1,193,374 | 8/1916 | Gilliam . |
| 1,332,461 | 3/1920 | Bowden . |
| 1,749,999 | 3/1930 | Crocker . |
| 2,956,616 | 10/1960 | Labusky et al. . |
| 3,237,939 | 3/1966 | Olivet et al. . |
| 3,447,832 | 6/1969 | Shaw . |
| 3,529,818 | 9/1970 | Aijala . |
| 3,721,437 | 3/1973 | Skaricic . |
| 3,730,587 | 5/1973 | Bloxham et al. . |
| 4,666,017 | 5/1987 | Zimmerman . |
| 4,844,452 | 7/1989 | Tomosky et al. . |
| 4,922,860 | 5/1990 | Hutchings . |
| 4,981,110 | 1/1991 | Llewellyn . |
| 5,120,287 | 6/1992 | Brown et al. . |
| 5,190,512 | 3/1993 | Curran . |
| 5,269,737 | 12/1993 | Sobotka . |
| 5,356,355 | 10/1994 | Campbell . |

*Primary Examiner*—Lynne A. Reichard
*Attorney, Agent, or Firm*—Christensen O'Connor Johnson & Kindness PLLC

[57] ABSTRACT

The present invention is an infant walking and swimming aid comprising a harness having at least one adjustable shoulder strap, a lower adjustable body belt, an upper adjustable body belt, at least one crotch strap, and a high back belt. The infant walking and swimming aid also includes at least one of (a) a crossbar having a first end, a second end and two attachment portions such that the crossbar is attachable to two adjustable suspending straps connectable between the crossbar and the harness; and (b) a first float attachable adjacent the high back belt and a second float attachable adjacent the lower adjustable body belt and the upper adjustable body belt.

20 Claims, 8 Drawing Sheets

INFANT WALKING AND SWIMMING AID

BACKGROUND OF THE INVENTION

The invention relates generally to infant or toddler walkers and infant or toddler swimming aids; and more specifically to combination walking and swimming aids.

Adult-supported infant walking aids are known in the art. An early example is U.S. Pat. No. 1,193,374, entitled "Baby Walker" and issued on Aug. 1, 1916 to Gilliam. This device utilized a harness with adjustable waist belts and an adjustable handle. This device, however, has no crotch support, no adjustable shoulder straps, no safety tether, and can only be operated by a single adult.

Another example is U.S. Pat. No. 1,749,999, entitled "Manually-Held Supporting Device for Assisting Children in Learning to Walk" issued on Mar. 11, 1930 to Crocker. This device provides a vest-like harness along with two support straps. It has no crotch support, no shoulder strap adjustment, no support strap adjustments, and uses an inefficient lace-type fastener. Further, the support straps are not releasable and there is no safety tether.

A more recent example of adult-supported infant walking aids is shown by U.S. Pat. No. 5,120,287, entitled "Infant Walking Aide" and issued on Jun. 9, 1992 to Brown et al. This device shows a harness with crotch support and a bar by which an adult can support the device. However, this device presumably offers no adjustability. The harness loosely encloses the toddler. It has only a single belt strap encircling the toddler's waist and no shoulder straps. The lack of support straps makes the toddler susceptible to flipping backward or forward. The small bar handle allows the device to be operated by one hand of an adult, but it precludes other desirable configurations, such as two adults supporting the toddler simultaneously.

U.S. Pat. No. 5,356,355 issued to Campbell discloses an extremely versatile child walking harness which, like all of the above-discussed prior art, cannot be converted into a swimming aid.

Clearly, there exists a need for an improved combination child walking and swimming aid which: (1) is fully adjustable, (2) is adaptable to many different support configurations, (3) can be supported by one or two adults (thus sharing the load), (4) prevents a toddler from flipping backwards, (5) has a harness which may be worn by a toddler when the support straps are detached, (6) provides a safety tether for added security in dangerous areas; and (7) is configurable from the walking configuration into a swimming configuration by the addition of buoyant members to specific locations on the harness such that the wearer floats in a position in which the wearer's head and face remain above water.

SUMMARY OF THE INVENTION

The present invention is an infant walking and swimming aid comprising a harness having at least one adjustable shoulder strap, a lower adjustable body belt, an upper adjustable body belt, at least one crotch strap, and a high back belt. The infant walking and swimming aid also includes at least one of (a) a crossbar having a first end, a second end and two attachment portions such that the crossbar is attachable to two adjustable suspending straps connectable between the crossbar and the harness; and (b) a first float attachable adjacent the high back belt and a second float attachable adjacent the lower adjustable body belt and the upper adjustable body belt.

Preferably the first end and the second end of the crossbar extend beyond the two attachment points of the crossbar to form handles, and the crossbar has a preformed curve to facilitate supporting the crossbar by the neck of an operator. The infant swimming and walking aid also preferably includes a safety tether attachable to an operator and removably attached to the harness. Preferably the infant walking and swimming aid also includes a pivot connector which attaches the first float to the high back belt such that the first float pivots to support the shoulders, neck and head of a wearer and to provide upper body buoyancy. Additionally, the infant walking and swimming aid also includes an attachment belt between the lower adjustable body belt and the upper adjustable body belt to secure the second float to the harness between the lower adjustable body belt and the upper adjustable body belt. Furthermore, the first float of the infant walking and swimming aid is most preferably semicircular in shape such that the head of the wearer can be rested thereon when the wearer partially reclines in the water.

BRIEF DESCRIPTION OF THE DRAWINGS

These and other features of the present invention will be more fully appreciated when considered in light of the following specification and drawings in which.

DETAILED DESCRIPTION OF THE PREFERRED EMBODIMENTS

Figure 1:
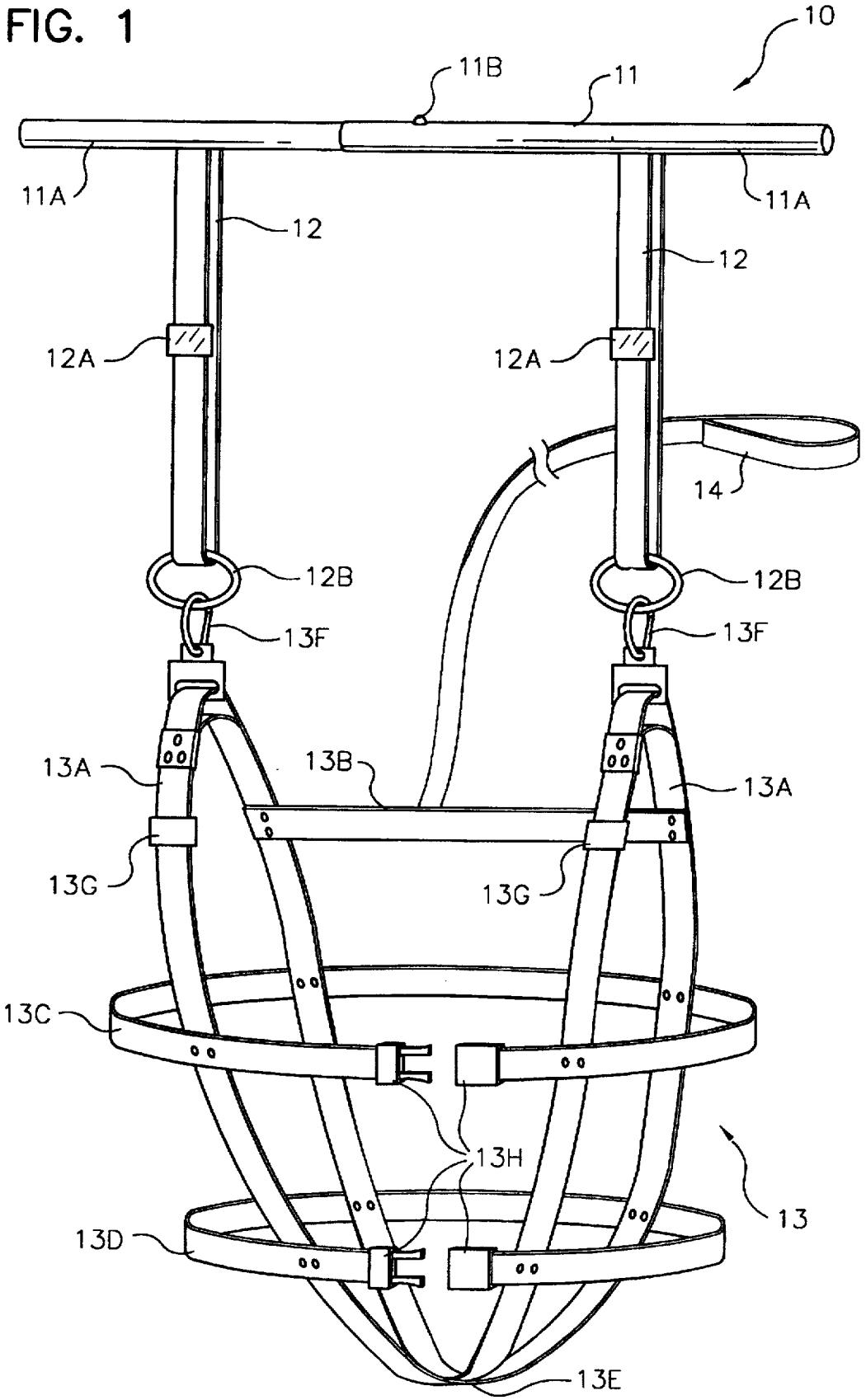
FIG. 1 shows a first embodiment of the invention in the walking aid configuration.

FIG. 1 shows the preferred embodiment of the invention in the walking aid configuration.

Toddler walking and swimming aid 10 is comprised of crossbar 11, suspending straps 12, harness 13, and safety tether 14. Harness 13 is further comprised of shoulder straps 13A, back support strap 13B, upper waist or body belt 13C, lower waist or body belt 13D, crotch straps 13E, and clips 13F.

Crossbar 11 is preferably made of lightweight tubing covered with thick foam padding. Handles 11A are formed by the crossbar extending beyond the suspending straps 12. In one embodiment, crossbar 11 is width-adjustable via a conventional push-button locking arrangement 11B.

Suspending straps 12 are length-adjustable via fasteners 12A commonly known in the art. One end of suspending straps 12 attaches to crossbar 11. A second end of suspending straps 12 easily clips to harness 13 via rings 12B and clips 13F.

Harness 13 is meant to fit snugly around a toddler and is therefore fully adjustable. Shoulder straps 13A are adjusted via shoulder strap adjustment means 13G. Similarly, waist belts 13C and 13D are adjustable via quick release buckles 13H which include strap adjustment means. Being fully adjustable permits the harness 13 to be custom-fit to the toddler, resulting in a high degree of security in holding the toddler. This design also allows the harness 13 to remain on the toddler when the suspending straps 12 and safety tether 14 are removed, thus eliminating the cumbersome task of removing and reattaching the harness 13 each time the walking aid device 10 is to be used.

A disadvantage in the prior art is the tendency of a toddler to flip rearward. This flaw is eliminated in the current invention by the back support strap 13B. The back support strap 13B attaches between the shoulder straps 13A and is positioned high on the toddler's back. This position provides the added support to prevent a rearward flip and any associated injury. In the preferred embodiment, the back support strap 13B is also the attachment point for the safety tether 14.

The harness is constructed using materials, fasteners, and manufacturing techniques commonly known in the art. The preferred embodiment uses nylon material fastened together with rivets. It is readily recognized that many similar materials and fasteners may be substituted.

Figure 2:
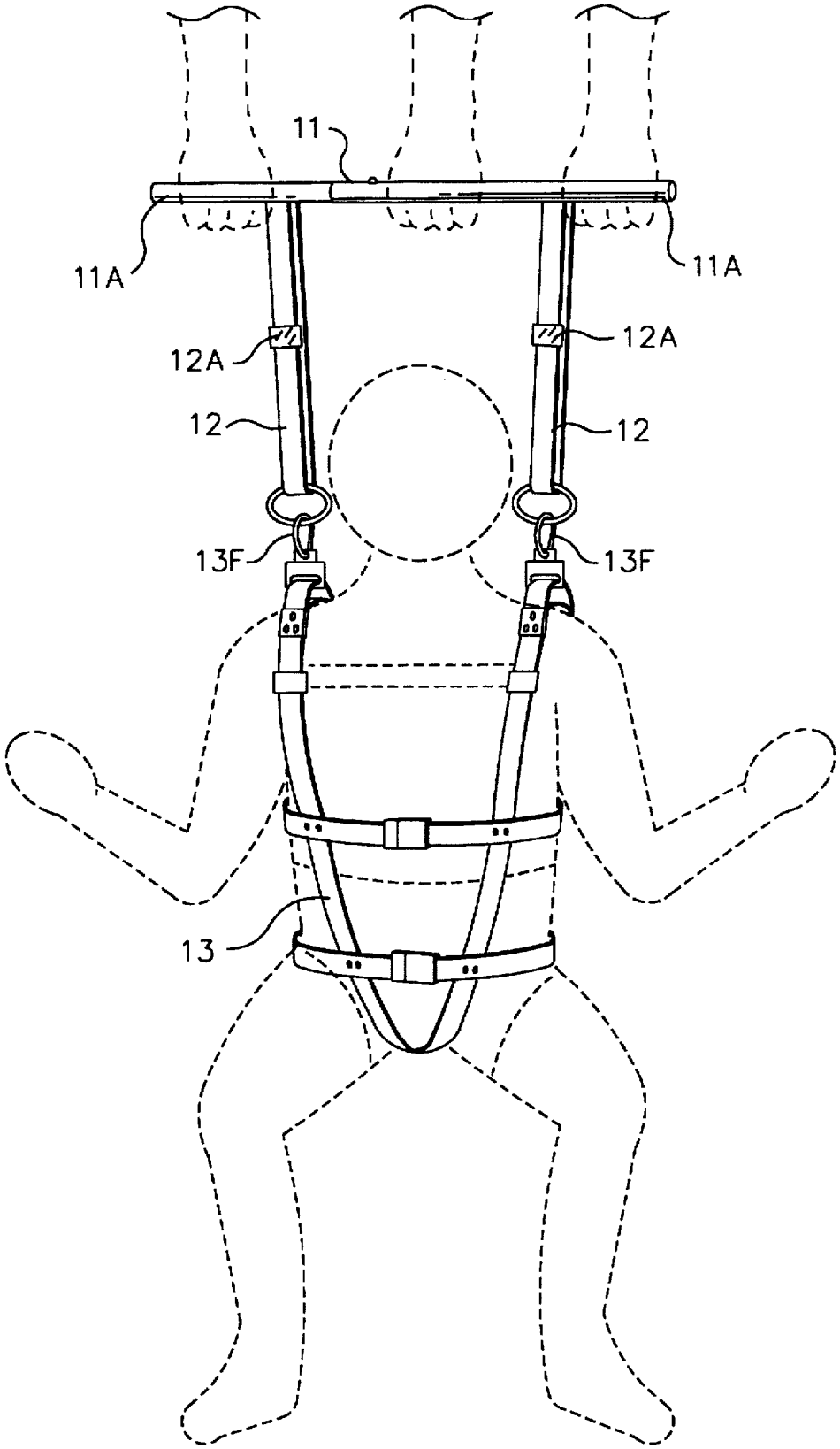
FIG. 2 shows the embodiment of FIG. 1 supporting a walking toddler and the crossbar being held by one or two hands of the operator(s)

FIG. 2 shows the invention in the walking aid configuration supporting a toddler and the crossbar being held by one or two hands of the operator(s).

Crossbar 11 is grasped by either one hand in the center of the crossbar 11 or by two hands at each end of the crossbar 11. Handle portions 11A make it convenient for two adults to assist the toddler simultaneously. Suspending straps 12 attach to clips 13F and support harness 13.

Figure 3:
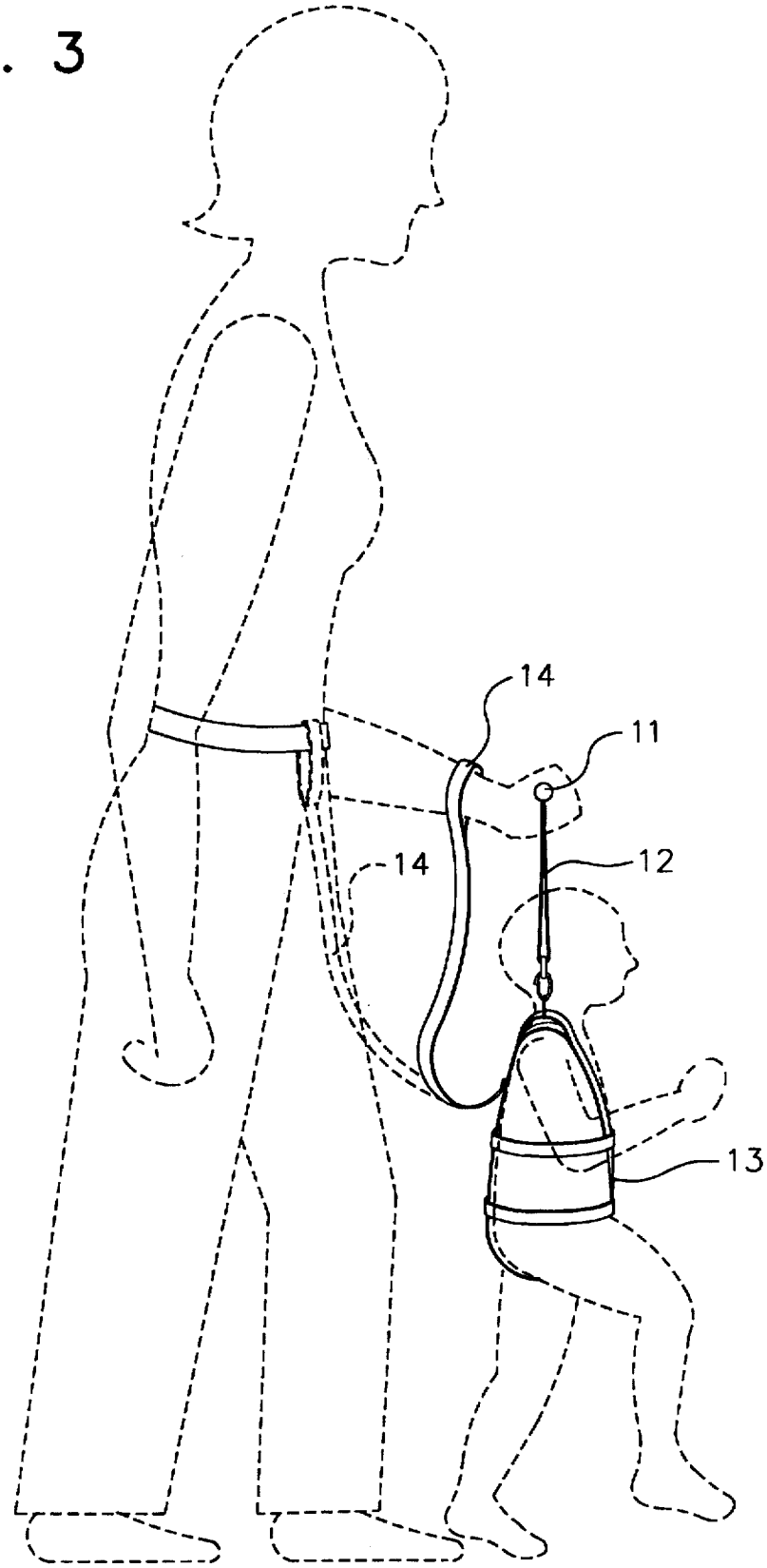
FIG. 3 shows the embodiment of FIG. 1 in the walking aid configuration, an adult or operator, and the safety tether.

FIG. 3 shows the invention in the walking aid configuration, the safety tether, and an adult operating the device. The adult grasps the crossbar 11 providing support to the harness 13 and toddler. The safety tether 14 clips or attaches to the rear of the harness 13. The opposite end of the safety tether 14 attaches to the wrist of the adult or alternatively, to the waist of the adult. The preferred embodiment uses hook and loop fasteners (i.e., "VELCRO") for this purpose.

Figure 4:
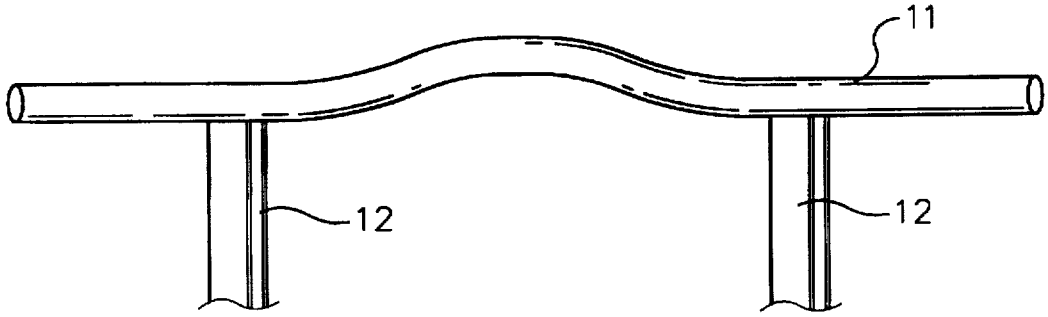
FIG. 4 shows a curved crossbar adapted for use behind the neck of the adult or operator in the walking aid configuration.

FIG. 4 shows a curved crossbar adapted for use behind the neck of the adult or operator. This is useful when, for various reasons, the operator does not want to support the toddler with his/her hands. For example, when the operator is carrying something in his/her arms, doing something with his/her hands, or merely desires a different configuration.

Figure 5:
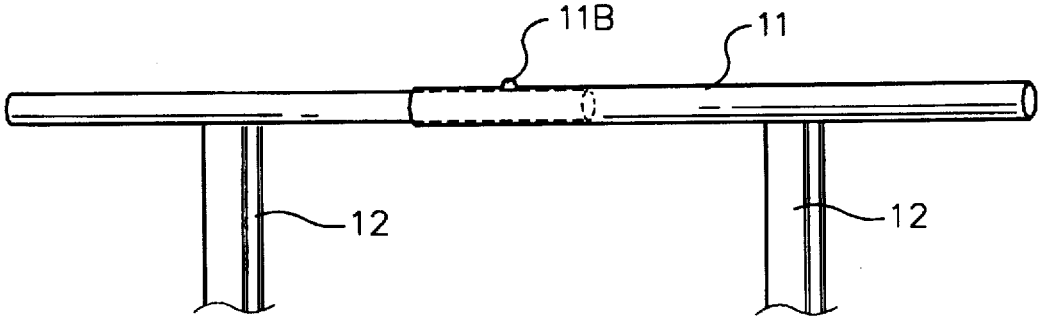
FIG. 5 is a width-adjustable crossbar with a button-locking mechanism for the walking aid configuration of the present invention.

FIG. 5 shows a width-adjustable crossbar with a button-locking mechanism. The width adjustment is particularly useful in shortening the crossbar 11 for a single operator, or lengthening the crossbar 11 for use by two operators.

Figure 6:
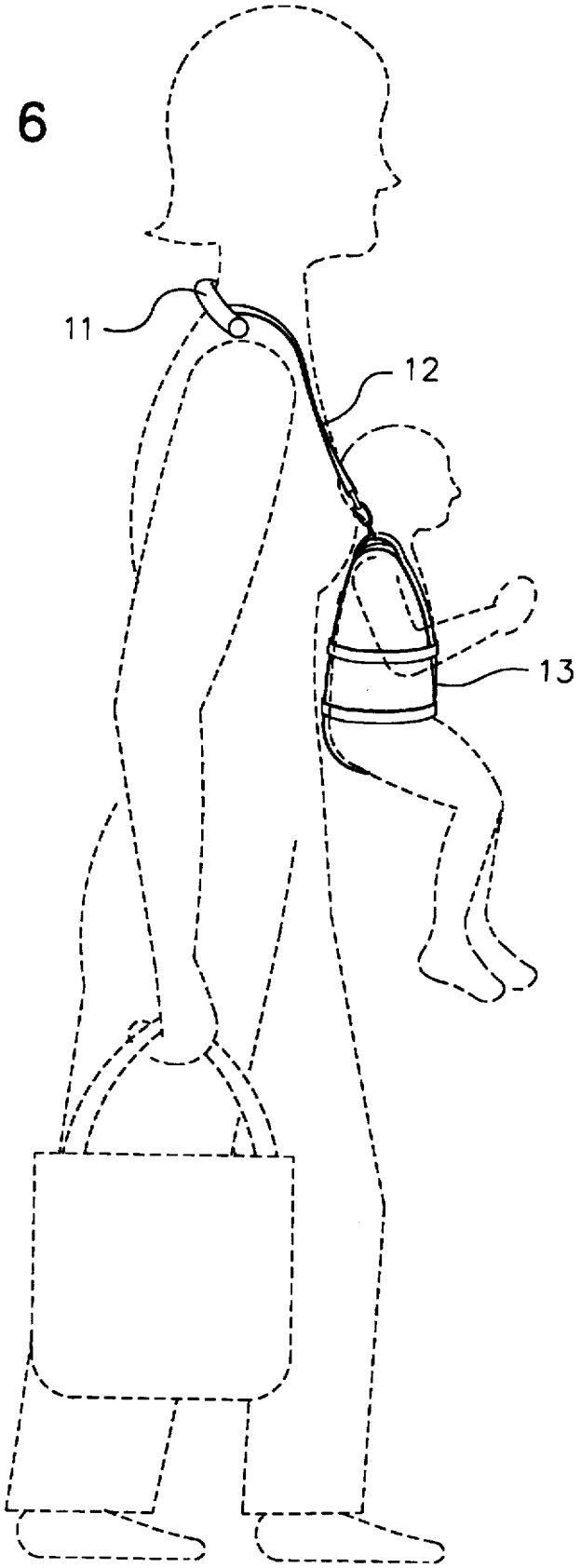
FIG. 6 shows the embodiment of FIG. 1 used with the crossbar supported by the neck and shoulders of the operator.
Figure 7:
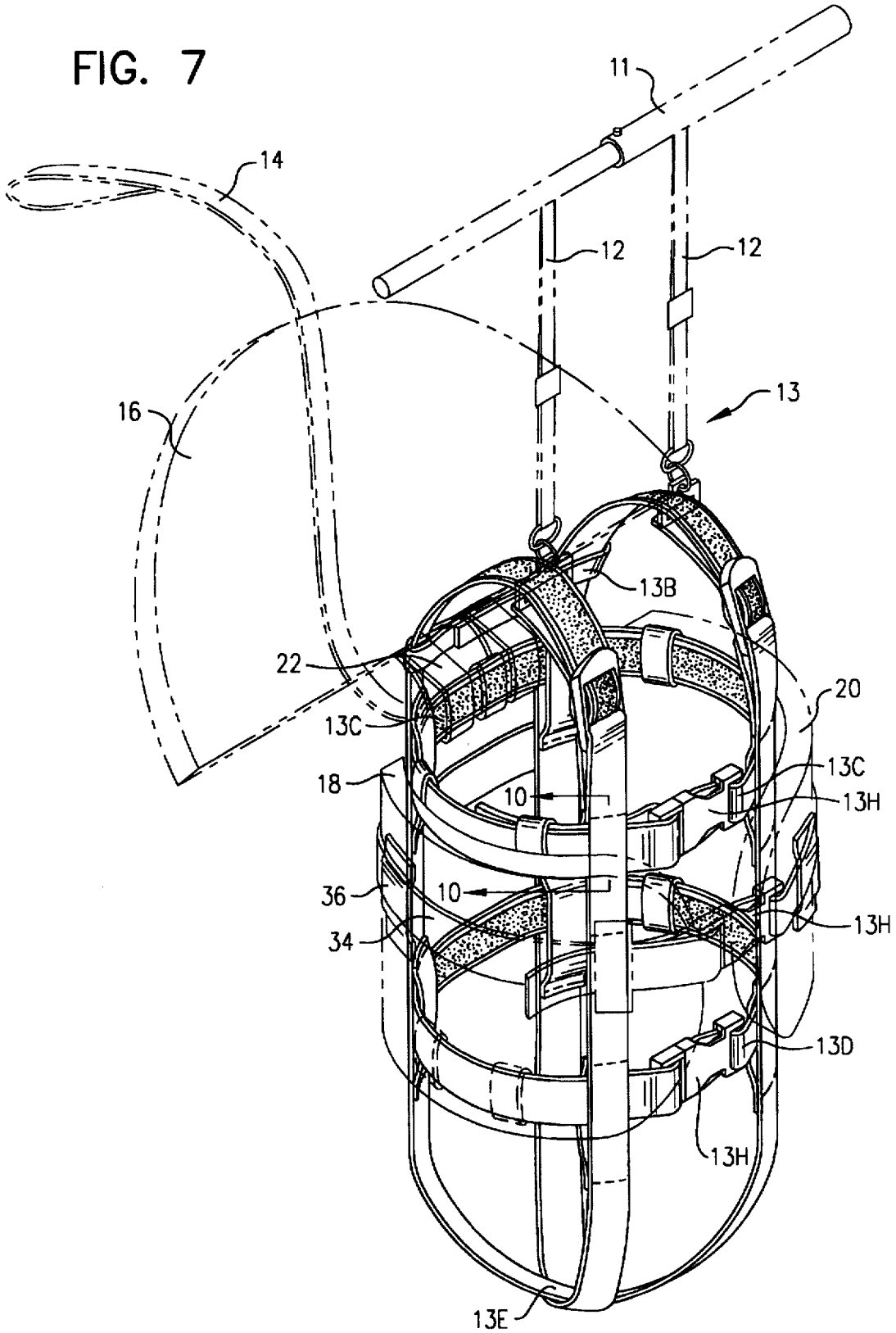
FIG. 7 shows a second embodiment of the invention in both the walking aid and swimming aid configurations.

FIG. 6 shows the device used with the crossbar supported by the neck and shoulders of the operator.

This configuration frees the hands of the operator while still supporting the toddler. The curved crossbar 11 rests on the operator's neck and shoulders. The suspending straps 12 are fully extended and attach to the harness 13 which supports the toddler.

The major portions of the harness 13, suspending straps 12, and safety tether 14 are preferably made of strong nylon material; however, those skilled in the art recognize that numerous other materials may be utilized. Likewise, all clips and buckles used in the toddler walking aid are preferably of the plastic or nylon quick fasten and release type commonly known in the art.

Figure 8:
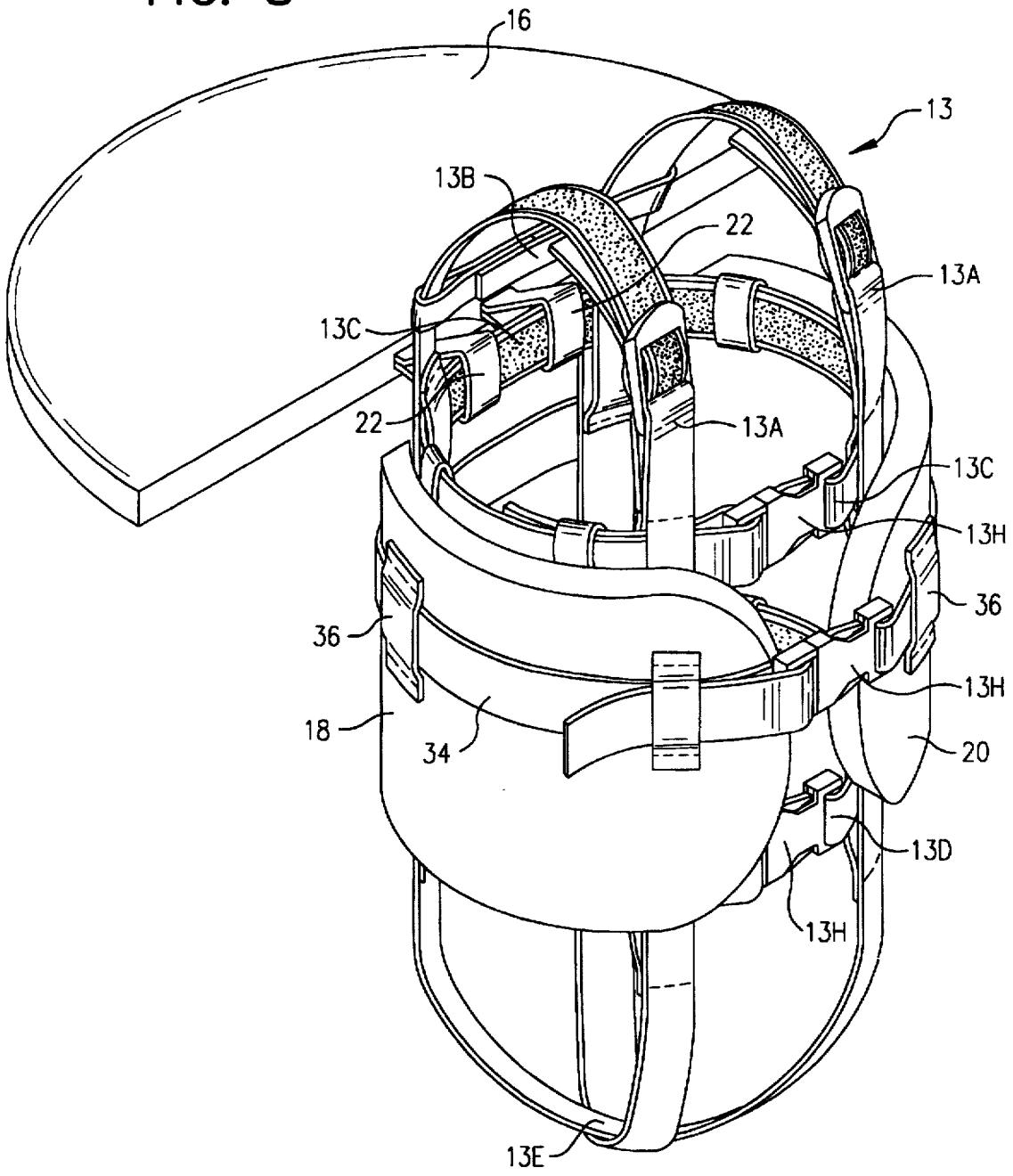
FIG. 8 shows the embodiment of FIG. 7 in the swimming aid configuration.
Figure 9:
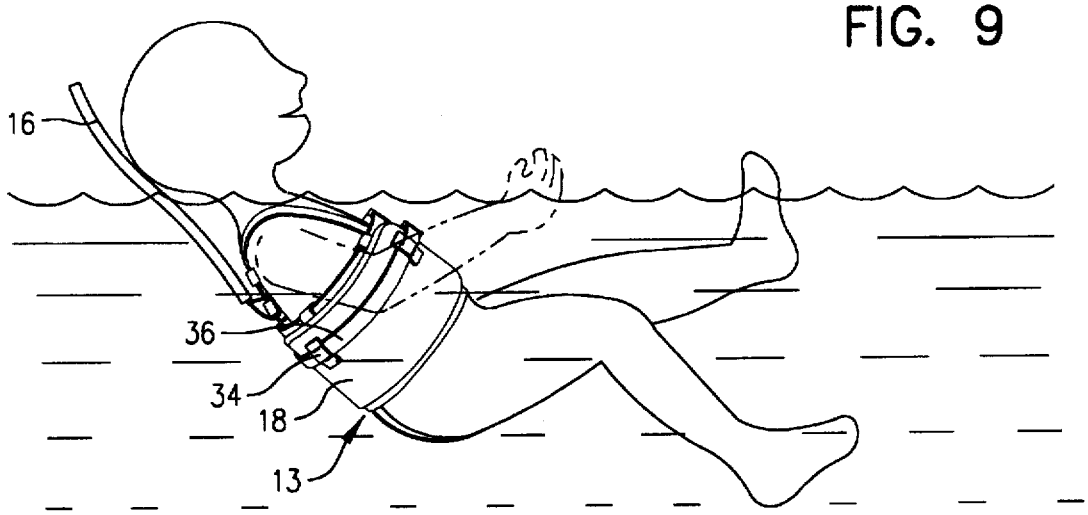
FIG. 9 shows the embodiment of FIG. 7 supporting a swimming toddler such that his face and head are maintained above water.

Referring now to FIGS. 7 through 10, the swimming aid configuration of toddler walking and swimming aid 10 is shown. More specifically referring to FIG. 7, the configuration of walking and swimming aid 10 is shown in which both the walking aid components (i.e., crossbar 11, suspending straps 12 and safety tether 14) and the swimming aid components (i.e., back float 16 and side floats 18 and 20) are simultaneously attached to toddler walking and swimming aid 10 such that toddler walking and swimming aid 10 can conveniently be used as both a walking aid and a swimming aid. Alternatively, toddler walking and swimming aid 10 can be configured such that the above walking aid components are removed, thus leaving only the swimming aid components as shown in FIGS. 8 and 9.

Figure 10:
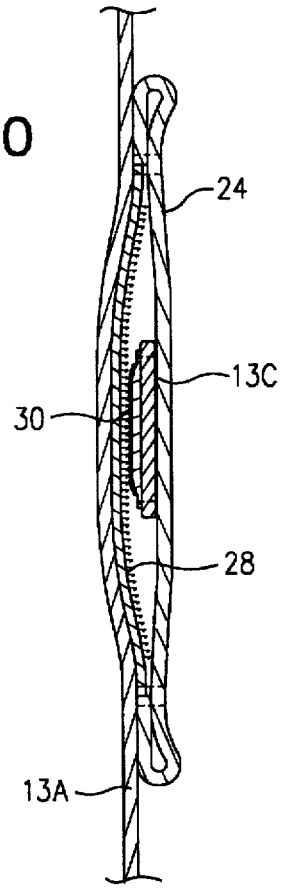
FIG. 10 is a cross-sectional view taken at lines 10—10 of FIG. 7 of the embodiment of FIG. 7 showing an exemplary method of attachment of floats to the invention in the swimming aid configuration.

More specifically referring to FIGS. 8 through 10, back float 16 is removably attached to upper waist or body belt 13C by back float loops 22, which pass through upper waist or body belt 13C. Unlike the embodiment shown in FIGS. 1 through 6, in the embodiment shown in FIGS. 7 through 10 back support strap 13B, upper waist or body belt 13C and lower waist or body belt 13D are not non-removably secured to shoulder straps 13A. Instead, shoulder straps 13A in FIGS. 8 through 10, as specifically shown in FIG. 10, are comprised of shoulder strap loops 24 securedly attached to shoulder straps 13A which allows upper waist or body belt 13C and lower waist or body belt 13D to be removably connected to shoulder straps 13A by passing through shoulder strap loops 24. The interior surfaces of both upper waist or body belt 13C and lower waist or body belt 13D are covered with a hook and loop material 26 such as "VELCRO", and the interior surface of shoulder strap loops 24 are also covered with a hook and loop material 28 such as "VELCRO" such that upper waist or body belt 13C and lower waist or body belt 13D are fixedly, but removably, secured within shoulder strap loops 24. Back support strap 13B in the embodiment of FIGS. 8 through 10 is also removably secured to shoulder straps 13A because back support strap 13B is a linear member with hook and loop material ("VELCRO") located on each end thereof such that back support strap 13B can form a removable loop around shoulder straps 13A. The aforesaid removability of upper waist or body belt 13C from shoulder straps 13A allows back float 16 to be removed from, or attached to, upper waist or body belt 13C by the removable connection of back float 16 to upper waist or body belt 13C by back float loops 22.

Side floats 18 and 20, which are preferably contoured, or contourable, floatation devices which fit the rib cage of the wearer, are removably secured to toddler walking and swimming aid 10 by means of side float belt 34, which passes through side float loops 36 on side floats 18 and 20.

Back float 16 and side floats 18 and 20 are preferably comprised of United States Coast Guard approved buoyant polymeric materials such as, for example, "INSOLITE", manufactured by Uniroyal Technology Corporation, 312 Hill Street, Mishawaka, Ind. 46544. The orientation of side floats 18 and 20 around the center of mass of the torso of the wearer, and the location of back float 16 proximate to the cervical vertebrae of the wearer ensures that the wearer will float in the water on his back with his head out of the water, as shown in FIG. 9. Furthermore, the substantially semi-circular shape of back float 16 provides a headrest for the wearer, and back float loops 22 allow back float 16 to pivot with respect to the wearer as the wearer alters the longitudinal axis of his body with respect to vertical in the water, such that back float 16 can continue to function as a headrest for the wearer and that the desired buoyant forces by back float 16 and side floats 18 and 20 are maintained regardless of the change in orientation of the wearer in the water.

While particular embodiments of the present invention have been described in some detail herein above, changes and modifications may be made in the illustrated embodiments without departing from the spirit of the invention.

I claim:

1. An infant walking and swimming aid comprising:

a harness means for securely supporting a small child, said harness means having at least one adjustable shoulder strap, a lower adjustable body belt, an upper adjustable body belt, at least one crotch strap, and a high back belt;

at least one of (a) a crossbar having a first end, a second end, and two attachment points, said crossbar attachable to two adjustable suspending straps connectable between said crossbar and said harness means; and (b) first float means attachable adjacent said high back belt and second float means attachable adjacent said lower adjustable body belt and said upper adjustable body belt; and an attachment belt between said lower adjustable body belt and said upper adjustable body belt, said attachment belt attaching said second float means to said harness means between said lower adjustable body belt and said upper adjustable body belt.

2. The infant walking aid according to claim 1 wherein said first end and said second end of said crossbar extend beyond said two attachment points of said crossbar forming handles.

3. The infant walking aid according to claim 1 wherein said crossbar has a pre-formed curve to facilitate supporting said crossbar by the neck of an operator.

4. The infant walking aid according to claim 1 further including a safety tether, said safety tether having a first end and a second end, said first end attached to an operator and said second end removably attached to said harness means.

5. The infant walking and swimming aid of claim 1 further comprising:

pivot means attaching said first float means to said high back belt, said pivot means allowing said first float means to pivot to support the shoulders, neck and head of a wearer and to provide upper body buoyancy.

6. The infant walking and swimming aid of claim 1 wherein said first float means is substantially semi-circular in shape.

7. An infant walking and swimming aid comprising:

a harness means for securely supporting a small child, said harness means having at least one adjustable shoulder strap, a lower adjustable body belt, an upper adjustable body belt, at least one crotch strap, and a high back belt;

first float means removably attachable to said high back belt;

second float means removably attachable adjacent said lower adjustable body belt and said upper adjustable body belt; and tether means removably attachable to said harness means such that said infant walking and swimming aid is in a walking configuration when said tether means is attached to said harness means and said first float means and said second float means are removed from said harness means, and said infant walking and swimming aid is in a swimming configuration when said tether means is removed from said harness means and said first float means and said second float means are attached to said harness means.

8. The infant walking and swimming aid of claim 7 further comprising:

pivot means attaching said first float means to said high back belt, said pivot means allowing said first float means to pivot to support the shoulders, neck and head of a wearer and to provide upper body buoyancy.

9. The infant walking and swimming aid of claim 7 further comprising:

an attachment belt between said lower adjustable body belt and said upper adjustable body belt, said attachment belt attaching said second float means to said harness means between said lower adjustable body belt and said upper adjustable body belt.

10. The infant walking and swimming aid of claim 7 wherein said first float means is substantially semi-circular in shape.

11. The infant walking aid according to claim 7 wherein said tether means is a line having a first end and a second end, said first end attached to an operator and said second end removably attached to said harness means.

12. The infant walking and swimming aide of claim 7 further comprising:

a crossbar having a first end, a second end, and two attachment points; and two adjustable suspending straps connectable between said crossbar and said harness means.

13. The infant walking aid according to claim 12 wherein said first end and said second end of said crossbar extend beyond said two attachment points of said crossbar forming handles.

14. The infant walking aid according to claim 12 wherein said crossbar has a pre-formed curve to facilitate supporting said crossbar by the neck of an operator.

15. An infant walking and swimming aid comprising:

a harness means for securely supporting a small child, said harness means having at least one adjustable shoulder strap, a lower adjustable body belt, an upper adjustable body belt, at least one crotch strap, and a high back belt;

first float means removably attached to said high back belt by pivot means such that said first float means pivots to support the shoulders, neck and head of a wearer and provides upper body buoyancy;

second float means removably attachable adjacent said lower adjustable body belt and said upper adjustable body belt; and an attachment belt between said lower adjustable body belt and said upper adjustable body belt, said attachment belt attaching said second float means to said harness means between said lower adjustable body belt and said upper adjustable body belt.

16. The infant walking and swimming aid of claim 15 wherein said first float means is substantially semi-circular in shape.

17. The infant walking aid according to claim 15 further including a safety tether, said safety tether having a first end and a second end, said first end attached to an operator and said second end removably attached to said harness means.

18. The infant walking and swimming aid of claim 15 further comprising:

a crossbar having a first end, a second end, and two attachment points; and two adjustable suspending straps connectable between said crossbar and said harness means.

19. The infant walking aid according to claim 18 wherein said first end and said second end of said crossbar extend beyond said two attachment points of said crossbar forming handles.

20. The infant walking aid according to claim 18 wherein said crossbar has a pre-formed curve to facilitate supporting said crossbar by the neck of an operator.

* * * * *